US006123593A

United States Patent [19]

Mercer

[11] Patent Number: 6,123,593

[45] Date of Patent: Sep. 26, 2000

[54] RUST PROOF BUOY MARKER

[76] Inventor: Terry D. Mercer, 2804 Duffton Loop, Tallahassee, Fla. 32303

[21] Appl. No.: 09/309,378

[22] Filed: May 10, 1999

[51] Int. Cl.[7] ..... B63B 22/18

[52] U.S. Cl. ..... 441/26; 441/6

[58] Field of Search ..... 441/6, 20, 21, 441/22, 23, 24, 25, 26

[56] References Cited

U.S. PATENT DOCUMENTS

| | | | |
|---|---|---|---|
| 3,162,870 | 12/1964 | Laird | 441/16 |
| 4,657,517 | 4/1987 | Godwin | 441/1 |
| 4,778,422 | 10/1988 | Saulnier et al. | 441/26 |
| 5,087,216 | 2/1992 | Noggle | 441/26 |
| 5,188,551 | 2/1993 | Keller | 441/6 |
| 5,256,093 | 10/1993 | Balstad | 441/25 |
| 5,376,035 | 12/1994 | Forrest | 441/26 |
| 5,947,780 | 9/1999 | Kellner et al. | 441/6 |

*Primary Examiner*—S. Joseph Morano
*Assistant Examiner*—Andrew D. Wright

[57] ABSTRACT

A highly visible container protected polyurethane foam flotation buoy, with a transparent polycarbonate housing enclosing a plastic line spool which is supported by a stainless steel axle which has a stainless steel rewind handle, with nylon roller, and a adjustable nylon brake assembly. Housing is secured to bottom of flotation buoy, housing assembly and spool assembly which are used in the deployment and take up of anchor and anchor line comprises complete flotation unit. Anchor is a five pound steel core enclosed in PVC with a stainless steel connection bolt. In use anchor will have descended to bottom and buoy will be on top surface of water connected by anchor line and will not drift off marked spot.

1 Claim, 5 Drawing Sheets

RUST PROOF BUOY MARKER

FIELD OF THE INVENTION

The present invention relates to a buoy marker constructed of materials highly resistant to rust and corrosion, whereby giving the buoy marker a long life span in the harsh marine environment.

BACKGROUND OF THE INVENTION

Buoy markers are very popular with boating and fishing enthusiast for the purpose of marking fishing spots, wrecks on the bottom of the gulf or ocean, dive sites, marking out race courses, ski courses, and to mark spots where articles were lost from boats and many more applications. Some buoy markers may be as simple as a gallon jug, a string and a weight, but these are not very efficient to use and sometimes drift off mark. Anchor lines have to be wound by hand around a jug and sometimes tangle. This does not work very well and does not last very long. It is therefore, desirable to provide a buoy marker that is easy to use, works well and will last for a long period of time.

BRIEF DESCRIPTION OF THE DRAWINGS (In the drawings)

FIG. 1 a perspective of buoy/spool housing and anchor

FIG. 2 cut-away view to show housing attachment and foam fill

FIG. 3 perspective of anchor

FIG. 4 perspective view of buoy deployed in water

FIG. 5 side exploded view of housing construction with buoy attachment plate FIG. 6 exploded front view of housing with buoy attachment plate FIG. 7 flat face view of housing bottom plate FIG. 8 flat face view of housing top plate portion FIG. 9 flat front view of spool arrangement with axle pin FIG. 10 flat face view of brake FIG. 11 flat face view of brake showing adjustment screw threaded channel.

Drawing Reference Numerals Worksheet

| | PART NAME | | PART NAME |
|---|---|---|---|
| 14 | Whole Invention | 44c | Stainless Steel Screw Passage Hole |
| 20 | Polyethylene Container Assembly | 44d | Stainless Steel Screw Passage Hole |
| 21 | Polyethylene Handle | 45a | Nylon Brake Block Hole Threaded |
| 22 | Polyethylene Locking Lid | 45b | Nylon Brake Block Hole Threaded |
| 23 | Polyurethane Foam Flotation | 50 | Nylon Brake Block Assembly |
| 24a | Top Orange Florescent Stripe | 51 | Nylon Brake Block |
| 24b | Bottom Orange Florescent Stripe | 52a | Staintess Steel Screw |
| 30 | Polycarbonate Housing Assembly | 52b | Stainless Steel Screw |
| 32a | Polycarbonate Side Plate | 53 | Staintess Steel Axle Passage Hole |
| 32b | Polycarbonate Side Plate | 54 | Stainless Steel Adjustment Screw Passage Hole |
| 33a | Polycarbonate Bottom Plate | 55 | Stainless Steel Adjustment Screw |
| 33b | Polycarbonate Top Plate | 56 | Adjustment Screw Closure Slot |
| 34 | Handle Assembly | 57a | Stainless Steel Mounting Screw Passage Hole |
| 35 | Anchor Line Slot | 57b | Stainless Steel Mounting Screw Passage Hole |
| 36a | Stainless Steel Bolt | 58 | Threaded Hole for Stainless Steel Adjustment Screw |
| 36b | Stainless Steel Bolt | 60 | Plastic Spool Assembly |
| 37a | Stainless Steel Washer | 61 | Stainless Steel Axle |
| 37b | Stainless Steel Washer | 62 | Brass Pin |
| 38 | Polycarbonate Reinforcement Plate | 63 | Stainless Steel Handle Rod |
| 38a | Stainless Steel Mounting Bolt Passage Hole | 64 | Nylon Roller |
| 38b | Stainiess Steel Mounting Bolt Passage Hole | 65 | Stainless Steel Lock Nut |
| 39 | Stainless Steel Housing Screws | 66 | Stainless Steel Set Screw |
| 39a | Threaded Hole for Stainless Steel Screw | 67 | Plastic Spool |
| 39b | Threaded Hole for Stainless Steel Screw | 70 | #18 Nylon Braided Anchor Line 150# Test |
| 39c | Threaded Hole for Stainless Steel Screw | 71 | Staintess Steel Coated 150# Test Leader Wire |
| 39d | Threaded Hole for Stainless Steel Screw | 72a | Crimp Sleeve |
| 41a | Threaded Hole for Stainless Steel Screw | 72b | Crimp Sleeve |
| 41b | Threaded Hole for Stainless Steel Screw | 73 | Brass Swivel |
| 41c | Threaded Hole for Stainless Steel Screw | 74a | Crimp Sleeve |
| 41d | Threaded Hole for Stainless Steel Screw | 74b | Crimp Sleeve |
| 42a | Stainless Steel Nut | 80 | Anchor Assembly |
| 42b | Stainless Steel Nut | 81 | Stainless Steel Connection Bolt |
| 43a | Stainless Steel Screw Passage Hole | 82 | PVC Tube |
| 43b | Stainless Steel Screw Passage Hole | 83a | Top PVC Cap |
| 43c | Stainless Steel Screw Passage Hole | 83b | Bottom PVC Cap |
| 43d | Stainless Steel Screw Passage Hole | 84 | Five Pound Steel Core |
| 44a | Stainless Steel Screw Passage Hole | | |
| 44b | Stainless Steel Screw Passage Hole | | |

SUMMARY OF THE INVENTION

It is therefore the principal object to provide a buoy marker that is easy to use, works extremely well, efficient to use and will last for a long period of time.

It is also an object of the present invention to provide a buoy marker that is resistant to rust and corrosion.

To achieve the above objects there is provided a buoy marker constructed of materials which are highly resistant to rust and corrosion, has easy operation characteristics, is efficient to use, and has a long life span in the harsh marine environment.

DETAILED DESCRIPTION OF PREFERRED EMBODIMENTS

Figure 1:
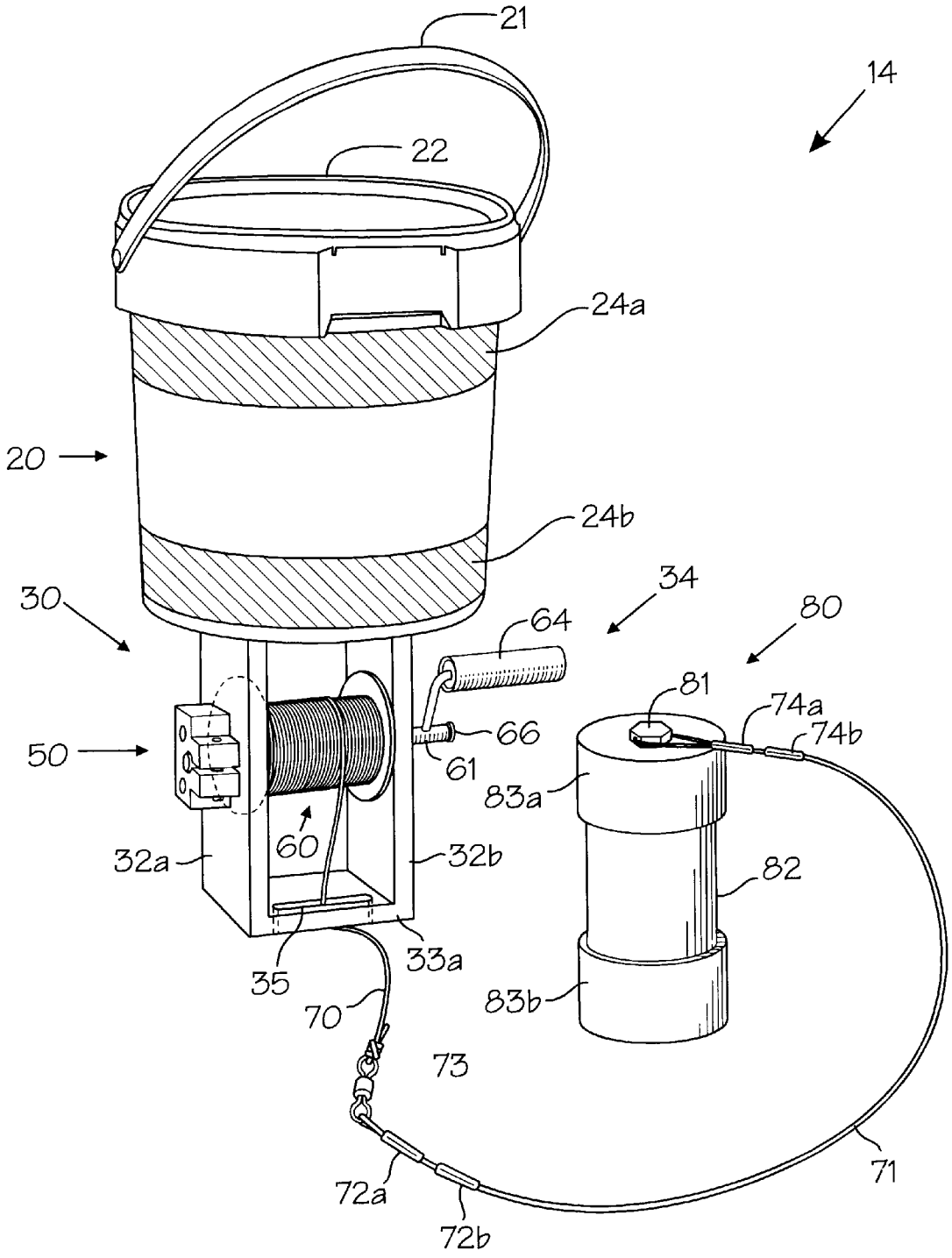
Figure 2:
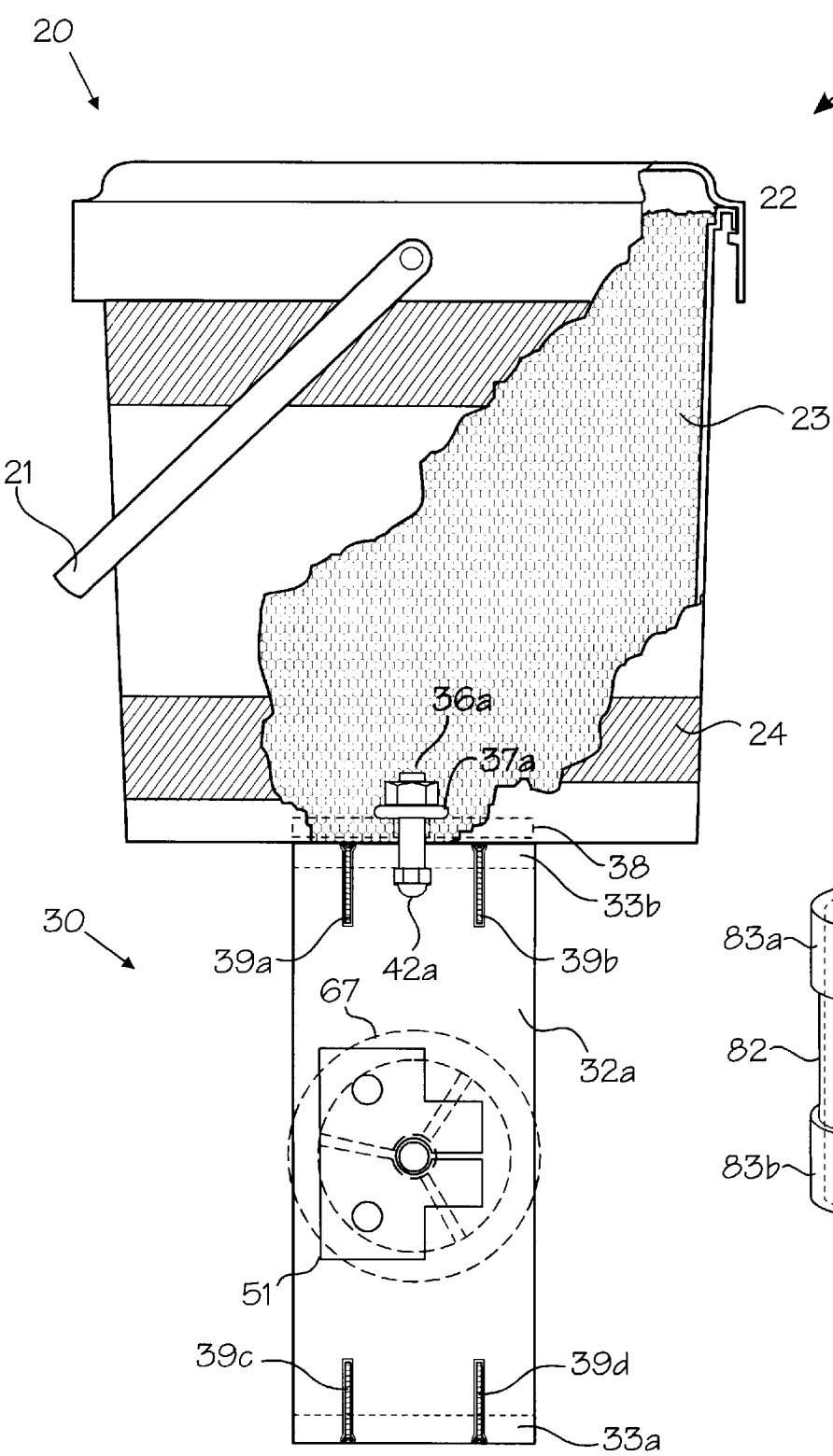
Figure 6:
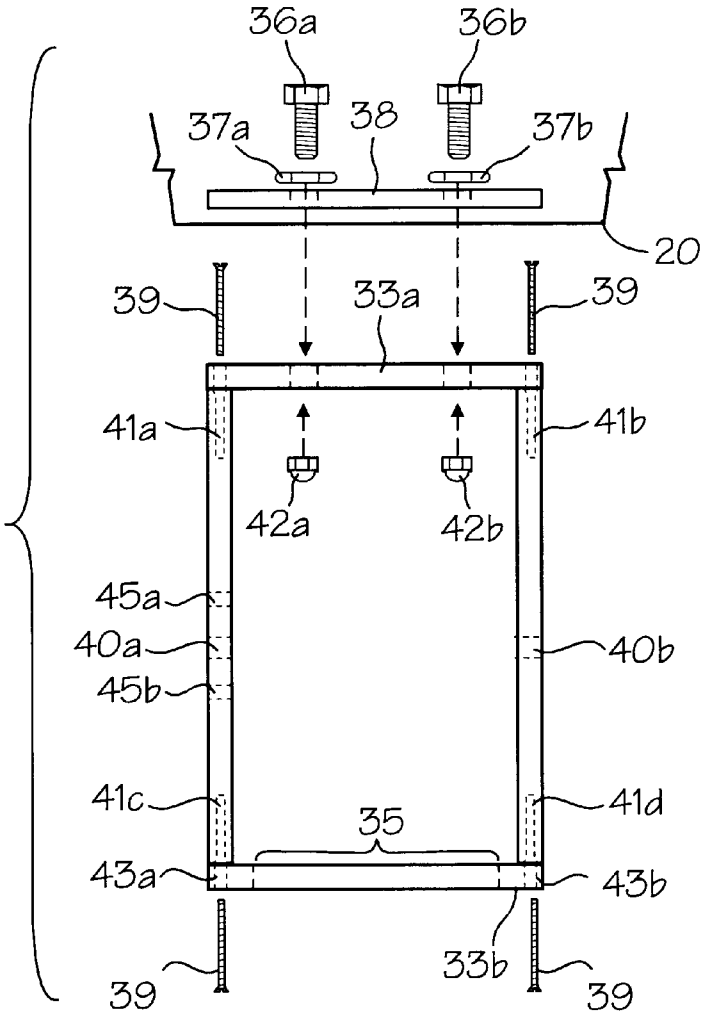
Figure 5:
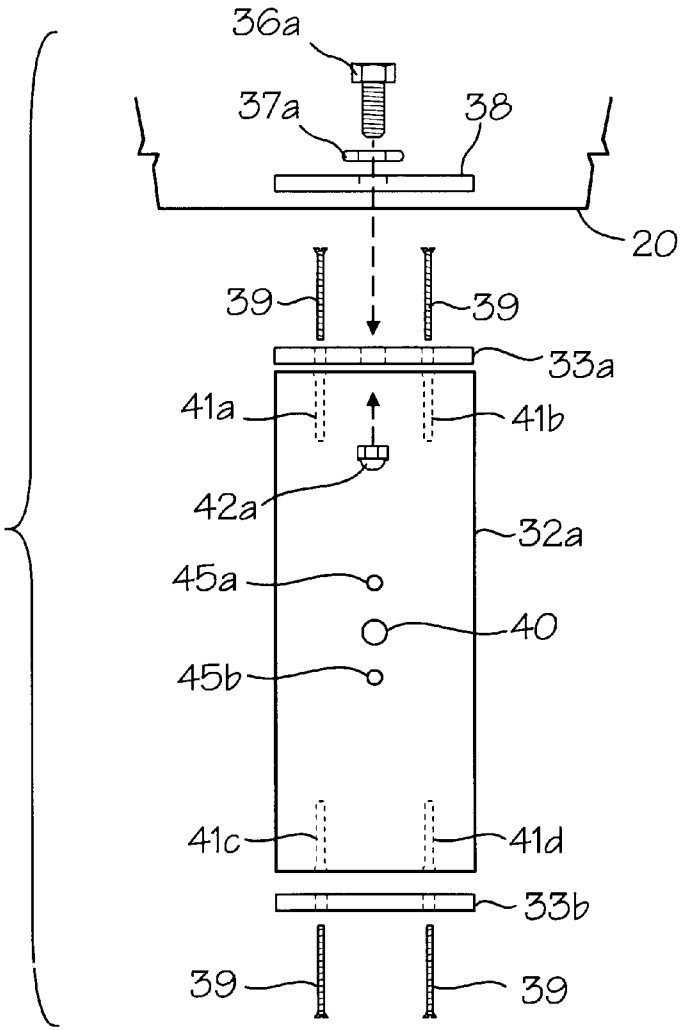

With reference to the drawing and in particular to FIG. 1 wherein a buoy marker assembly generally designated with the reference numeral 14 is shown. The buoy marker assembly 14 comprises a polyethylene container 20, a polyethylene handle 21, a polyethylene locking lid 22, and two orange florescent stripes 24*a* at top and 24*b* at bottom. The polyethylene container assembly 20 is mounted to top polycarbonate plate 33*b* shown in FIG. 8 by a securing procedure using two stainless steel bolts 36*a* and 36*b*. A reinforcement polycarbonate plate 38, two stainless steel washers 37*a* and 37*b* two stainless steel nuts 42*a* and 42*b*. A below water line grade silicone sealant is applied between polyethylene container assembly 20 and top polycarbonate plate 33*b* for a waterproof seal. The securing procedure is shown in FIG. 2, FIG. 5 and in FIG. 6.

Figure 8:
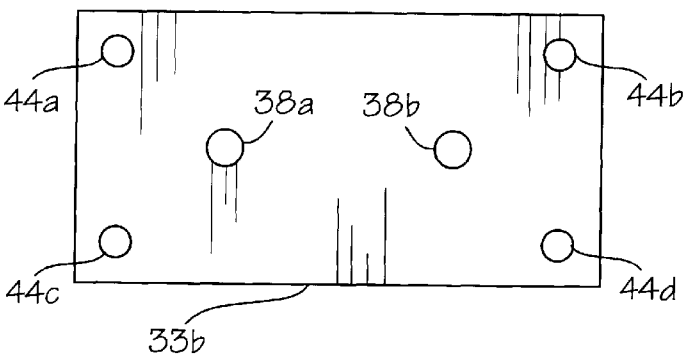
Figure 7:
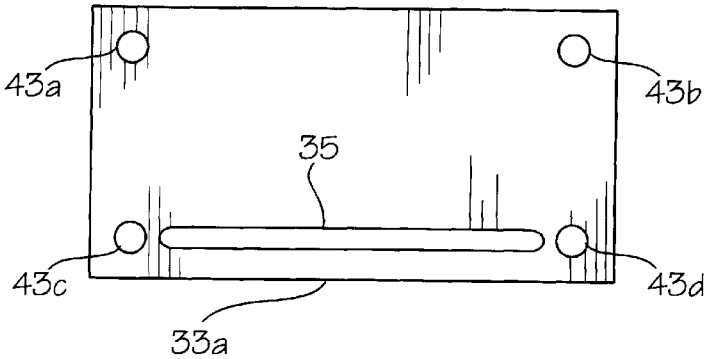

A housing comprises a top polycarbonate plate 33*b* shown in FIG. 8. The top polycarbonate plate 33*b* has four stainless steel screw passage holes 44*a*, 44*b*, 44*c*, and 44*d*. Two stainless steel mounting bolt passage holes 38*a* and 38*b* and side plate 32*a* has threaded holes at four corners, top and bottom 41*a*, 41*b*, 41*c*, and 41*d*. It also has a axle passage hole 40*a* and two threaded holes 45*a* and 45*b* for mounting nylon brake 50. Polycarbonate side plate 32*b* has threaded holes at four corners top and bottom 39*a*, 39*b*, 39*c*, and 39*d* including axle passage hole 40*b*.

Bottom polycarbonate plate 33*a* has four stainless steel screw passage holes 43*a*, 43*b*, 43*c*, and 43*d* at corners and a anchor line slot 35 at front.

All four polycarbonate plates described above are secured with stainless steel screws 39 at corners using passage holes and tread holes at all four corners.

Figure 9:
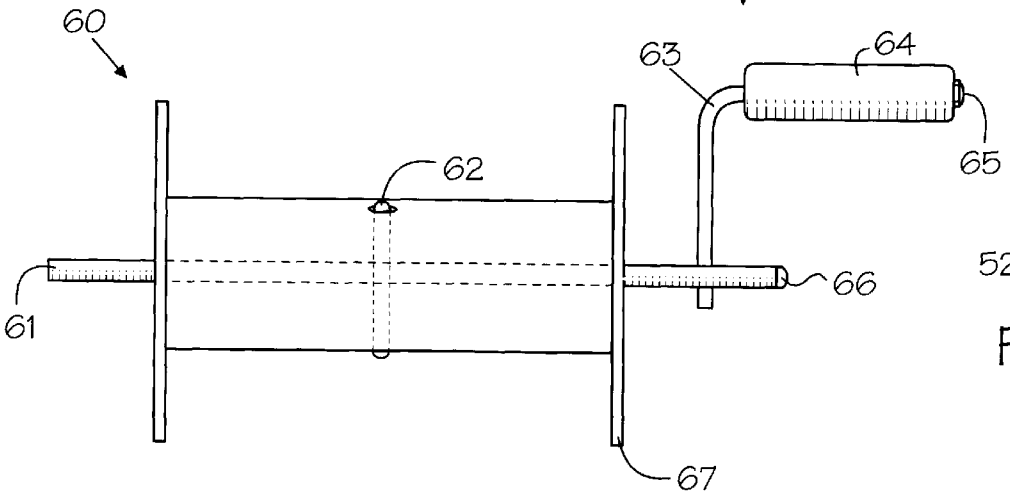

The housing assembly 30 encloses a plastic line spool 67. A brass pin 62 is installed through spool and middle of a stainless steel axle 61 shown in FIG. 9. The stainless steel axle 61 has a stainless steel rewind handle assembly 34 which comprises a stainless steel handle rod 63 and a nylon roller 64. A stainless steel lock nut 65 keeps nylon roller 64 in place and a stainless steel set screw 66 secures stainless steel handle rod 63 shown in FIG. 9

Figure 10:
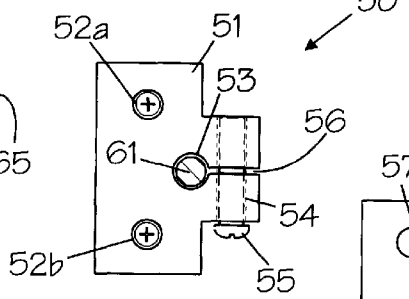
Figure 11:
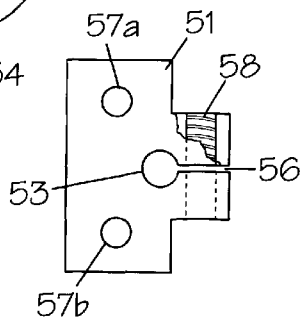

A nylon brake assembly 50 is mounted by two stainless steel screws 52*a* and 52*b* over stainless steel axle 61 and to polycarbonate side plate 32*a*. The nylon brake assembly 50 is comprised of a stainless steel adjustment screw 55, a stainless steel adjustment screw passage hole 54, a threaded hole 58 for stainless steel adjustment screw 55, a closure slot 56 for stainless steel adjustment screw 55, a passage hole 53 for stainless steel axle 61, and two stainless steel screw passage holes 57*a* and 57*b*. The nylon brake assembly 50 described is shown in FIG. 10 and FIG. 11.

The plastic anchor line spool 67 is filled with one hundred and fifty feet of number eighteen braided nylon line 70 of one hundred fifty pound test which is tied to brass swivel 73.

Two feet of one hundred fifty pound test stainless steel coated leader wire 71 is attached to swivel 73 with two crimp sleeves 72*a* and 72*b*. The leader wire 71 is threaded through a connection bolt 81 and attached with two crimp sleeves 74*a* and 74*b*. The connection bolt 81 is part of a anchor assembly 80 shown in FIG. 1.

Figure 3:
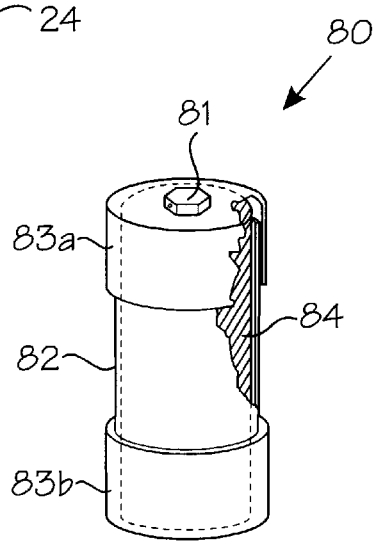

The anchor assembly 80 comprises of a five pound steel core 84, the stainless steel connection bolt 81, a PVC top cap 83*a*, a PVC tube 82 and a PVC bottom cap 83*b*. The anchor assembly 80 is bonded together with PVC glue so as to enclose steel core 84 in PVC outer covering shown in FIG. 1 and FIG. 3.

The polyethylene container 20 is filled with a polyurethane foam 23. Curing time for polyurethane foam 23 is about eight hours depending on air temperature. After the polyurethane foam 23 has cured, a locking polyethylene lid 22 is then installed using a bead of below water line grade of silicone sealant for water proof seal.

Figure 4:
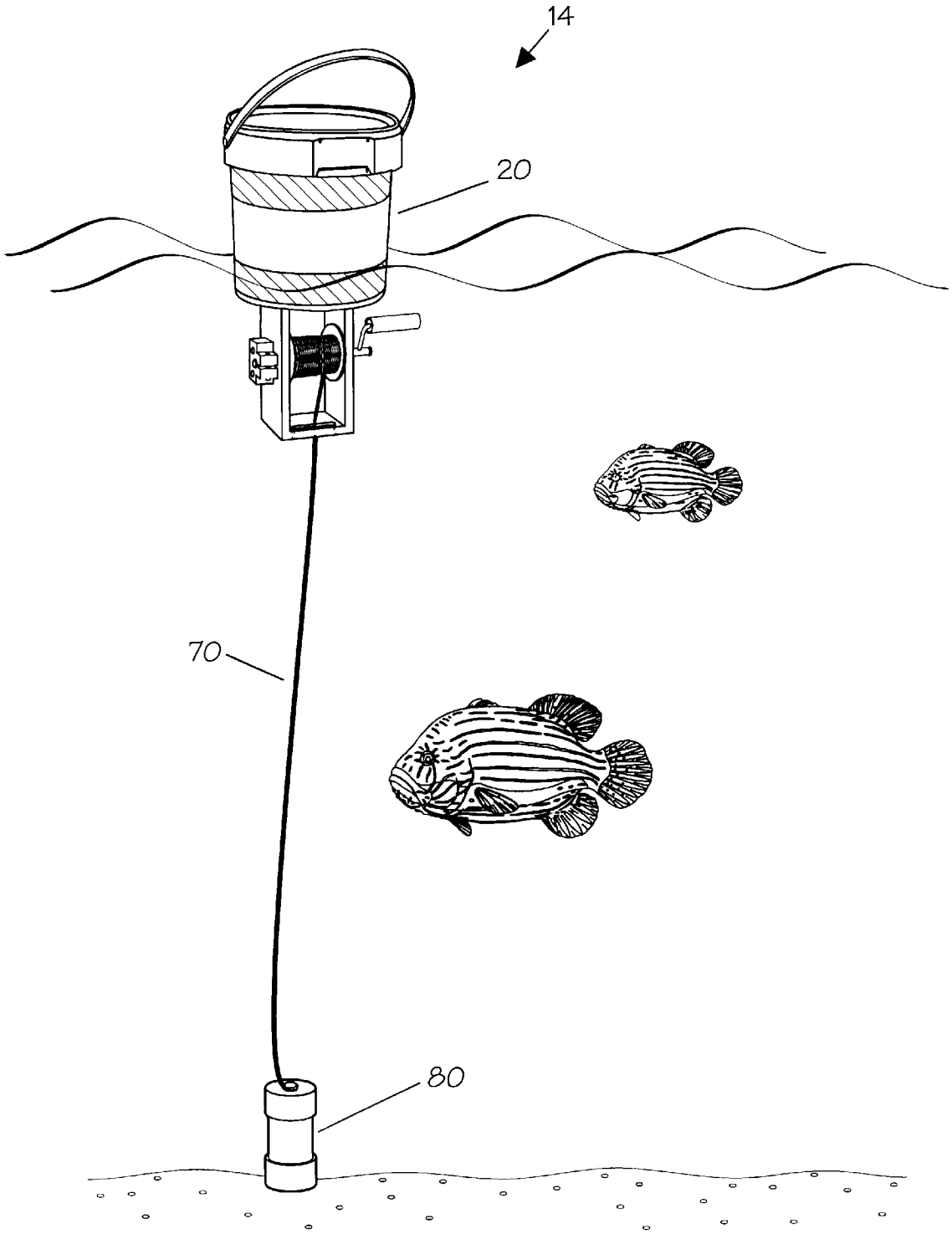

A perspective view of finished buoy marker 14 deployed is shown in FIG. 4. The flotation buoy assembly 20 is on the waters top surface, anchor 80 is on bottom surface and they are connected by anchor line 70.

It is apparent that although the invention has been described in connection with the preferred embodiment, it is contemplated that those skilled in the art may make changes to certain features of the preferred embodiment without altering the basic concept of the invention.

What I claim is:

1. A rust proof buoy marker comprised of a. polyethylene container protected polyurethane foam flotation buoy, including handle and locking lid, two florescent orange stripes, one at top portion of container and one at bottom portion of container, b. a transparent polycarbonate housing fastened together with stainless steel screws, enclosing a plastic anchor line spool, supported by a stainless steel axle, with a stainless steel rewind handle, with a nylon roller and a adjustable axle brake made of nylon, with stainless steel adjustment and mounting screws, c. securing procedure between buoy and polycarbonate housing to include top polycarbonate attachment plate and polycarbonate reinforcement plate, d. a anchor with a five pound steel core enclosed in PVC with a top PVC cap, a PVC tube, a bottom PVC cap and a stainless steel connection bolt, e. a nylon anchor line attached to line spool and anchor.

* * * * *